US007201284B2

(12) United States Patent
Clark et al.

(10) Patent No.: US 7,201,284 B2
(45) Date of Patent: Apr. 10, 2007

(54) VENTED CONTAINER

(75) Inventors: Joseph M. Clark, Naugatuck, CT (US); Richard S. Chomik, Middlesex, NJ (US)

(73) Assignee: Playtex Products, Inc., Westport, CT (US)

( * ) Notice: Subject to any disclaimer, the term of this patent is extended or adjusted under 35 U.S.C. 154(b) by 138 days.

(21) Appl. No.: 10/302,775

(22) Filed: Nov. 22, 2002

(65) Prior Publication Data

US 2003/0116573 A1 Jun. 26, 2003

Related U.S. Application Data

(60) Provisional application No. 60/333,564, filed on Nov. 27, 2001.

(51) Int. Cl.
*A61J 11/02* (2006.01)

(52) U.S. Cl. ..... 215/11.5

(58) Field of Classification Search ..... 215/11.5
See application file for complete search history.

(56) References Cited

U.S. PATENT DOCUMENTS 921,387 A * 5/1909 Etter ..... 215/11.5
4,728,006 A * 3/1988 Drobish et al. ..... 222/181.3
4,865,207 A * 9/1989 Joyner et al. ..... 215/11.5
5,499,729 A * 3/1996 Greenwood et al. ..... 215/11.5
5,597,881 A 1/1997 Winter et al.
6,138,710 A * 10/2000 Chomik et al. ..... 137/512.15
6,142,325 A * 11/2000 Chomik ..... 215/343
6,398,048 B1 6/2002 Kevorkian ..... 215/11.5

FOREIGN PATENT DOCUMENTS

| | | |
|---|---|---|
| DE | 8002108 | 1/1980 |
| DE | 8305369 | 12/1983 |
| DE | 4036361 | 4/1991 |
| DE | 4229224 | 3/1994 |
| DE | 19520540 | 12/1996 |
| EP | 0 593 888 | 4/1994 |
| EP | 0 895 773 | 2/1999 |

* cited by examiner

*Primary Examiner*—Stephen J. Castellano
(74) *Attorney, Agent, or Firm*—Ohlandt, Greeley, Ruggiero & Perle, L.L.P.

(57) ABSTRACT

There is provided a spill proof cup assembly having a cap with at least one spout outlet, a cup with an upper open portion adapted to securely and sealingly receive the cap, and a thermoplastic elastomer, or similar elastomeric material, co-molded bottom portion with a vent disposed therein for allowing air to enter the cup as fluid exits through the spout outlet. The result is a one-way flow of air.

6 Claims, 5 Drawing Sheets

VENTED CONTAINER

This appln. claims the benefit of prov. appln. No. 60/333,564 filed on Nov. 27, 2001.

BACKGROUND OF THE INVENTION

1. Field of the Invention

The present invention relates to a spill proof cup assembly for holding and dispensing drinkable fluids. More particularly, the present invention relates to a spill proof cup assembly having a thermoplastic elastomer (TPE) co-molded bottom with a vent or vent mechanism disposed therein to dissipate the vacuum created as fluid is withdrawn from the cup.

2. Description of the Related Art

Spill proof cups having caps with a fluid outlet spout and an air inlet vent to permit drinking from the cup without creating an excessive vacuum in the cup, are well known. Further, many of these cups have valving mechanisms, typically coupled with the cap, via the spout and/or the air vent, that respond to the suction generated during drinking to allow fluid to exit the spout and allow air to enter the vent as a vacuum develops in the interior of the cup.

Despite the effectiveness of these different cup/cap mechanisms, the applicant has discovered a unique venting mechanism for venting a cup without having a vent located at an upper portion of a cup, without sacrificing the cup's resistance to spills/leaks, and requiring fewer parts. In addition, the present invention may also allow the cup to be formed of more brittle cup materials.

SUMMARY OF THE INVENTION

It is an object of the present invention to provide an improved spill proof cup assembly that is substantially leak-proof.

It is another object of the present invention to provide such a spill proof cup assembly having a thermoplastic elastomer (TPE) co-molded bottom with a vent disposed therein.

It is still another object of the present invention to provide such a spill proof cup assembly that allows air to flow through the bottom of the cup via the vent to replace the volume of fluid as the fluid is removed.

It a further object of the present invention to provide a method of manufacture for a spill proof cup assembly having a TPE bottom with a vent disposed therein.

It is yet still a further object of the invention to provide a cup assembly having a soft, cushioned bottom portion for reducing the likelihood of cup breakage, resulting from dropping, and thereby allowing the cup assembly to be comprised of a wider range of materials, including more brittle materials.

These and other objects and advantages of the present invention are achieved by a spill proof cup assembly having a cup with an upper open portion and a bottom portion. The bottom portion has a vent disposed therein. The assembly preferably has a cap, with at least one fluid outlet, and adapted to enclose the upper open portion.

DETAILED DESCRIPTION OF THE INVENTION

Figure 1:
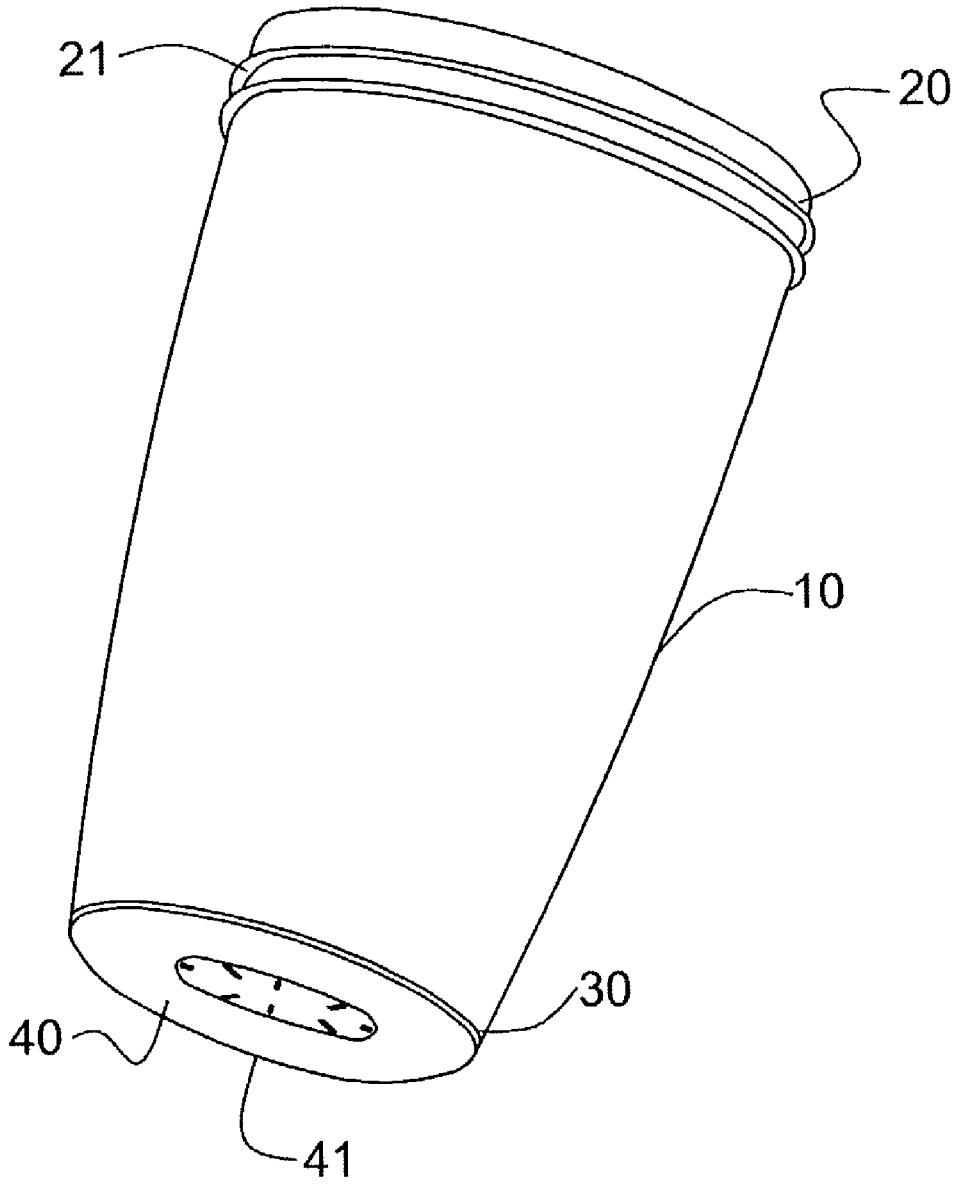
FIG. 1 is a perspective view of a cup assembly in accordance with the present invention.
Figure 3:
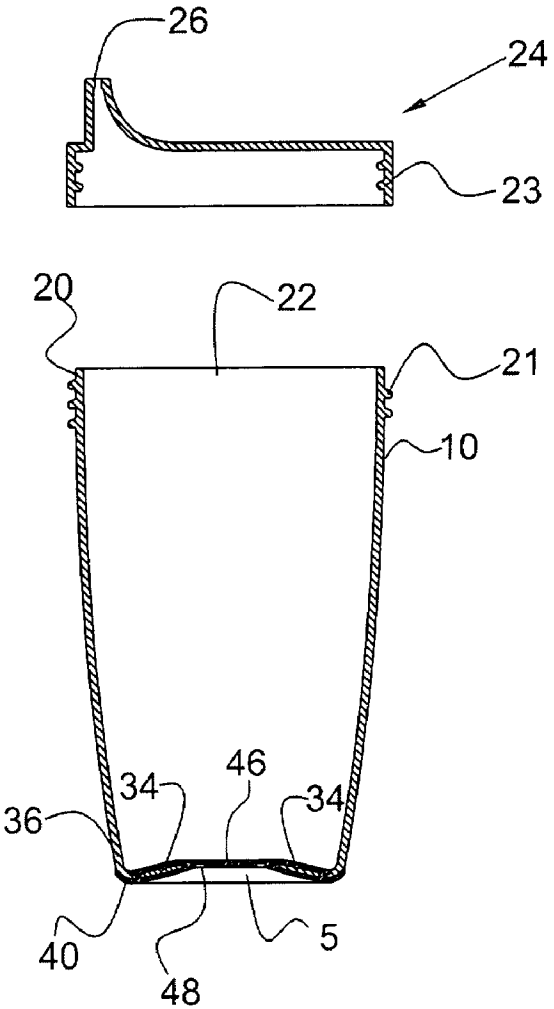
FIG. 3 is a side section view of the cup assembly of FIG. 1, highlighting the cup and co-molded TPE bottom.
Figure 2:
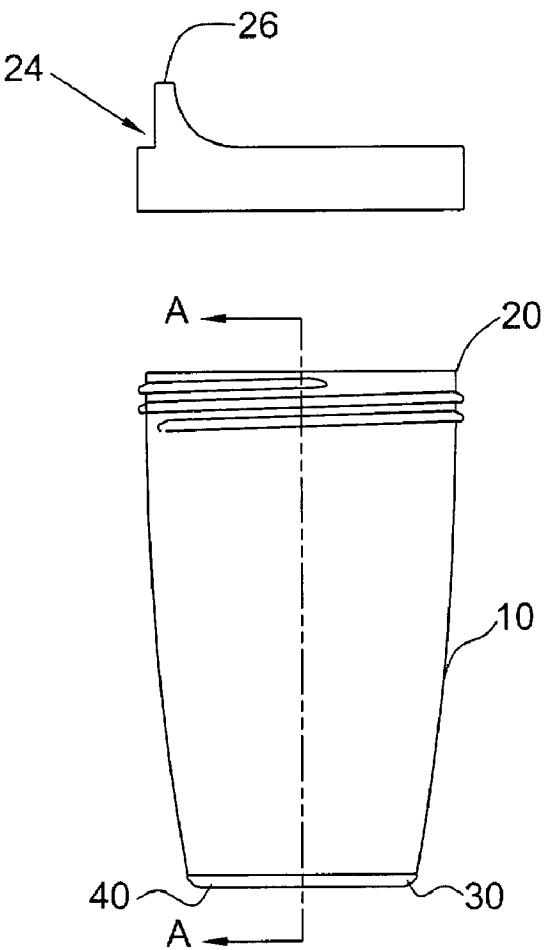
FIG. 2 is a side view of the cup assembly of FIG. 1.
Figure 4:
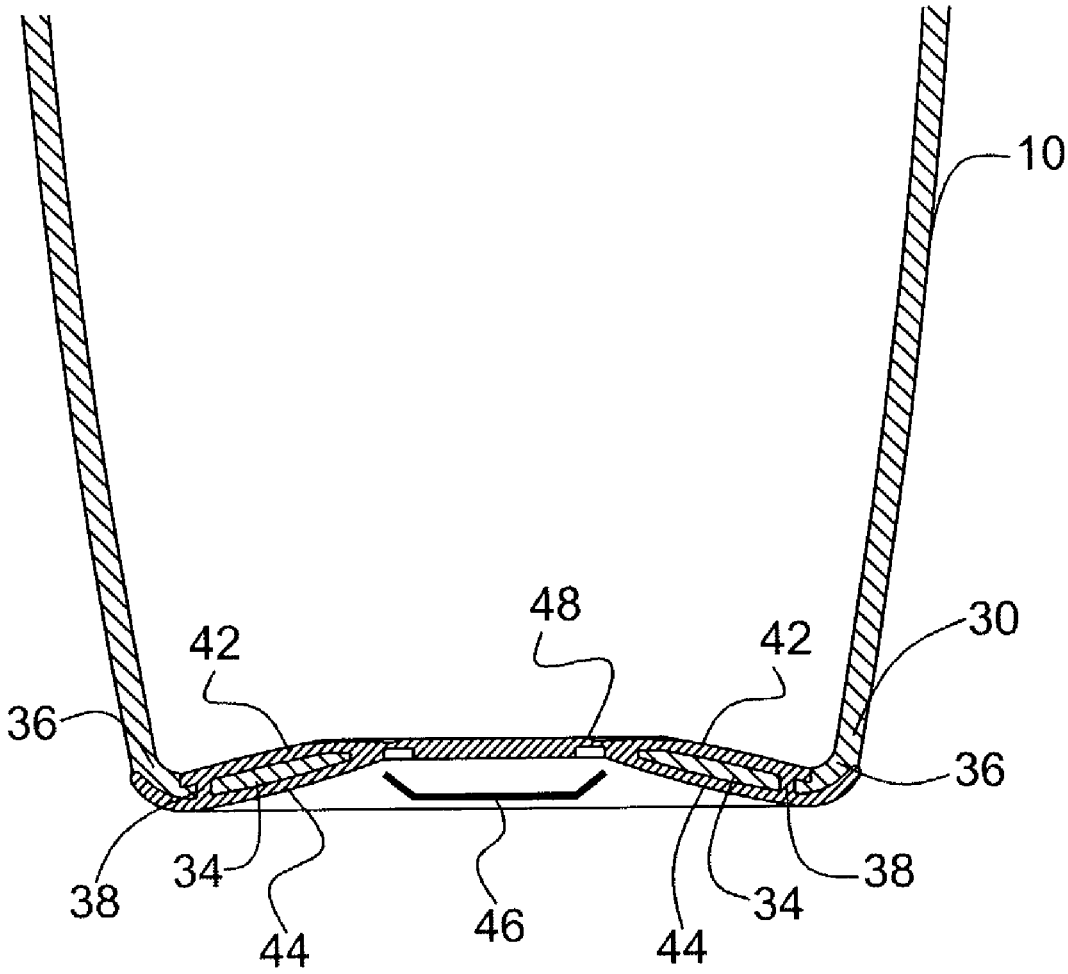
FIG. 4 is an enlarged view of the cup assembly of FIG. 3, highlighting not only the cup component and co-molded TPE bottom but also, vents disposed therein.

Referring to the drawings and in particular FIGS. 1 through 3, there is shown a spill proof cup assembly in accordance with a preferred embodiment of the present invention generally represented by reference numeral 1. Cup assembly 1 preferably has a cup or hollow body 10 with an upper end 20 and a lower end 30, and a flexible membrane 40 co-molded with lower end 30 to form a unitary container or device. Preferably, hollow body 10 and flexible membrane 40 are made of at least two distinct materials. These distinct materials preferably are polypropylene and thermoplastic elastomer (TPE), respectively. However, other materials such as for example high density polyethylene, polycarbonate, urethane rubber, and silicone may also be used. Further, hollow body 10 can be made of a more clarified, attractive brittle material.

Figure 5:
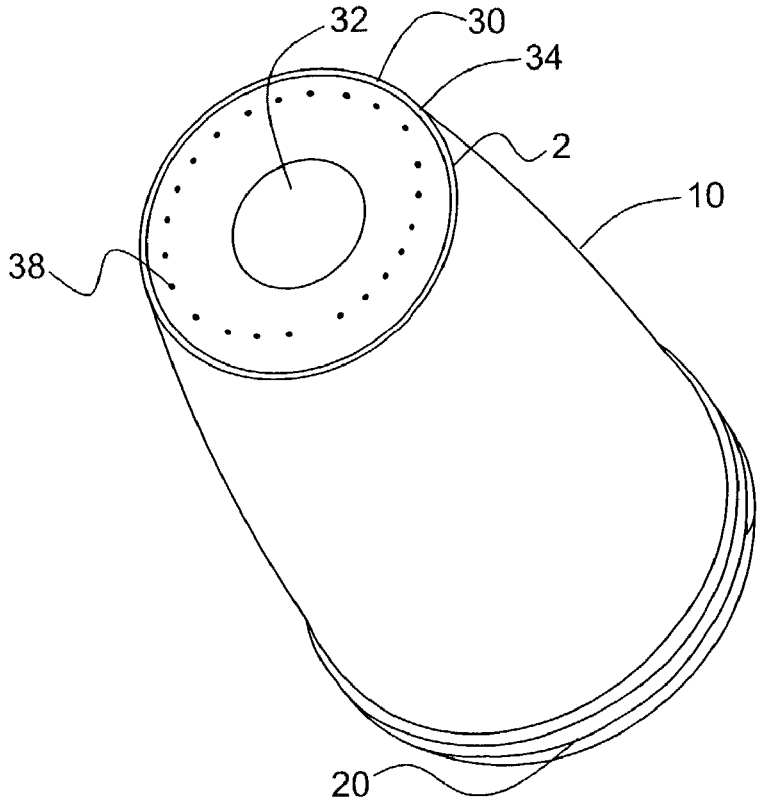
FIG. 5 is a bottom view of the cup assembly of FIG. 1, showing the polypropylene injection molded cup component before it is co-molded with TPE.
Figure 6:
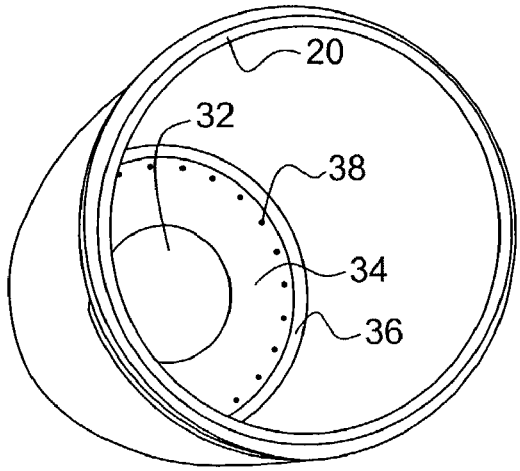
FIG. 6 is an interior bottom view of the cup assembly of FIG. 5.

Hollow body 10 preferably has an elongated central vertical axis A with an upper end 20 forming an upper opening 22 and a lower end 30 forming a lower opening 32 shown clearly in FIGS. 5 and 6. Preferably, upper end 20 selectively cooperates with a cap 24. Cap 24 preferably having at least one spout or fluid dispensing outlet 26. Upper end 20 preferably also has threads 21 for engaging corresponding threads 23 of cap 24. It should be noted, however, that upper end 20 may also be configured without threads such that cap 24 is snap fit over upper end 20. Preferably, lower end 30, as shown in FIGS. 3, 4, 5 and 6, has an inner flange 34 preferably running along a lower inner edge 36 of hollow body 10. Inner flange 34 preferably having one or more apertures serving as mechanical locks 38 when flexible membrane 40 is co-molded to hollow body 10.

Referring generally to FIGS. 1 through 8, preferably mechanical locks 38 are arranged such that when flexible membrane 40 is co-molded with hollow body 10, lower opening 32 is preferably filled with the elastomeric material or TPE and inner flange 34 is preferably sandwiched between two layers of TPE, an upper layer 42 and a lower layer 44. The result is a flexible membrane defining a vent area 46 that is actuated by differences in pressure. Preferably, mechanical locks 38 are small apertures advantageously situated in inner flange 34 allowing upper layer 42 and lower layer 44 to be connected through the inner flange.

Figure 7:
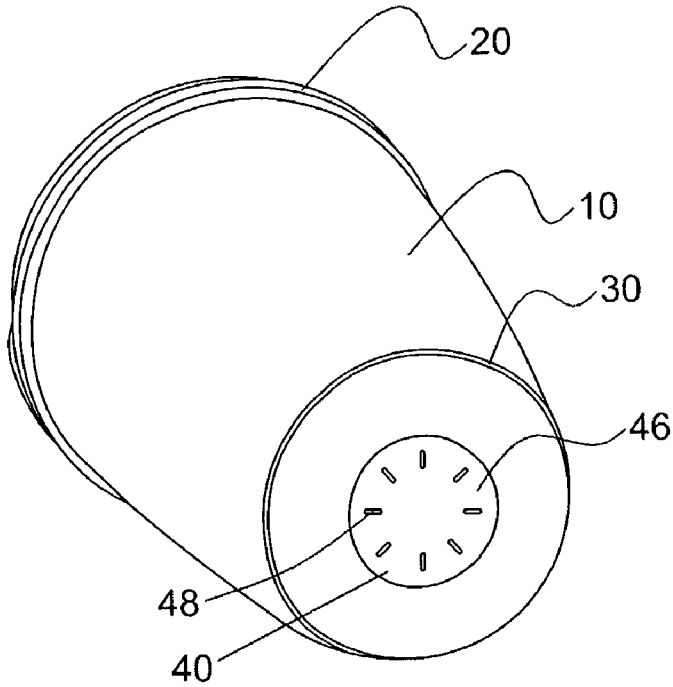
FIG. 7 is a bottom view of the cup assembly of FIG. 1, showing the polypropylene injection molded cup component after it is co-molded with TPE.
Figure 8:
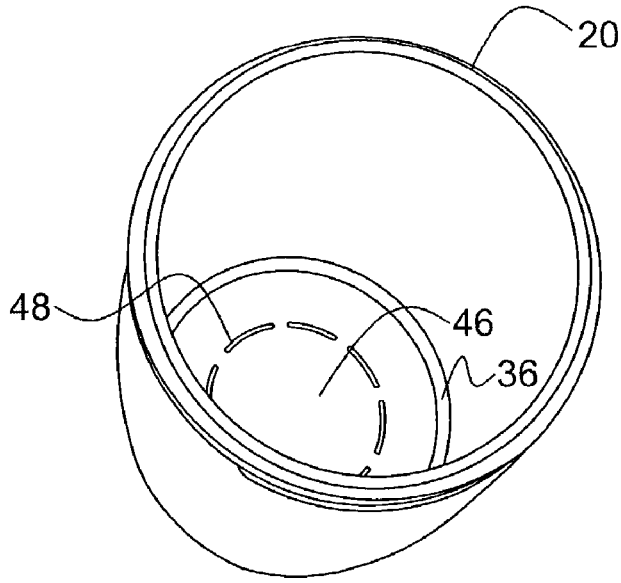
FIG. 8 is an interior bottom view of the cup assembly of FIG. 7.

Flexible membrane 40, preferably is soft and provides a cushioning protection for reducing the likelihood of the cup assembly being broken dropped or mishandled. Thus, the co-molding of flexible membrane 40 onto hollow body 10 preferably allows the hollow body to be formed from a more brittle material, which ordinarily would not be usable because of its more fragile nature. Vent area 46, preferably has one or more dimples or vents 48. Vents 48 preferably are molded into shape and pierced via a secondary operation. The result is a dimple/pierce that behaves as a pressure actuated valve for allowing air to enter the cup while preventing fluid from leaking out. Vents 48 are preferably positioned as shown in FIGS. 7 and 8, with the dimple side facing outwardly from lower end 30. This configuration is important, as there are mechanical advantages that can be leveraged therefrom. For example, as fluid pushes down on vents 48, the pressure preferably causes the adjacent surfaces of upper layer 42 and lower layer 44, which are fashioned by the secondary piercing operation, to be pressed against each other causing vents 48 to close. Conversely, when there is a vacuum within the cup and pressure builds on the outer side of vents 48, the adjacent surfaces of upper layer 42 and lower layer 44 separate causing vents 48 to open. Thus, the configuration shown in FIGS. 7 and 8, preferably facilitates lower end 30 being in compression with vents 48 closed, when there is a positive pressure in the cup, and in tension with vents 48 open, when there is a negative pressure in the cup. This provides the functional performance desired (i.e. a one way flow).

Cup assembly 1 is preferably configured to allow air to enter hollow body 10 through lower end 30 via vents 48 to replace fluid being removed from the cup via outlet spout 26 of cap 24. This helps reduce the vacuum that tends to develop within hollow body 10 as fluid exits during drinking.

Cup assembly 1 is preferably formed by injection molding hollow body 10 such that upper end 20 is open and lower end 30 is open with inner flange 34 reducing the cross-sectional area of the lower end opening to be less than that of the upper end opening. Once hollow body 10 is formed, flexible membrane 40 is preferably co-molded to lower end 30 such that the flexible membrane enfolds inner flange 34 and fills lower opening 32 to define vent area 46.

The present invention having been thus described with particular reference to the preferred forms thereof, it will be obvious that various changes and modifications may be made therein without departing from the spirit and scope of the present invention as defined herein.

What is claimed is:

1. A container comprising:

a hollow body having a first end, a second end and an inner volume; and a flexible membrane having a vent area, wherein said vent area has a one-way pressure actuated valve that allows flow of air into said inner volume, wherein said hollow body has an inner flange along a lower inner edge of said second end with one or more apertures, and wherein said flexible membrane has an upper layer and a lower layer extending around said flange filling in said one or more apertures thereby securing said flexible membrane to said flange.

2. The container of claim 1, further comprising a dispensing orifice disposed on said first end of said hollow body, wherein said vent area dissipates a vacuum created in said inner volume as a fluid is withdrawn from said hollow body through said dispensing orifice and wherein said one-way pressure actuated valve is a resealable aperture.

3. The container of claim 2, wherein said first end is sealed except for said dispensing orifice.

4. The container of claim 1, wherein said one-way pressure actuated valve has at least one aperture, and wherein said at least one aperture is formed through said flexible membrane.

5. The container of claim 4, wherein said at least one aperture is a plurality of openings that are arranged in a substantially circular pattern.

6. The container of claim 4, wherein said second end is a lower end of said hollow body, wherein said lower end has a bottom wall at least partially traversing said lower end, wherein said bottom wall has at least one opening formed therethrough, and wherein said at least one aperture in said flexible membrane is offset along a longitudinal axis of said hollow body from said at least one opening in said bottom wall.

* * * * *